US011518672B2

(12) United States Patent
Tasaka et al.

(10) Patent No.: US 11,518,672 B2
(45) Date of Patent: Dec. 6, 2022

(54) FLUID PRESSURE FEEDING DEVICE

(71) Applicants: TOYOTA JIDOSHA KABUSHIKI KAISHA, Toyota (JP); PYLES JAPAN Co., LTD., Yokohama (JP); TOYOTA PRODUCTION ENGINEERING, Munakata (JP)

(72) Inventors: Masahiro Tasaka, Nissin (JP); Kunimi Abiru, Nagoya (JP); Shoji Suzuki, Yokohama (JP); Takatoshi Urashi, Nisshin (JP); Katsura Hara, Nisshin (JP); Tomohiro Tokunaga, Kurate-gun (JP); Naoki Yamaguchi, Kitakyushu (JP)

(73) Assignees: TOYOTA JIDOSHA KABUSHIKI KAISHA, Toyota (JP); PYLES JAPAN Co., LTD., Yokohama (JP); TOYOTA PRODUCTION ENGINEERING, Munakata (JP)

( * ) Notice: Subject to any disclaimer, the term of this patent is extended or adjusted under 35 U.S.C. 154(b) by 214 days.

(21) Appl. No.: 17/137,567

(22) Filed: Dec. 30, 2020

(65) Prior Publication Data

US 2021/0238024 A1 Aug. 5, 2021

(30) Foreign Application Priority Data

Feb. 3, 2020 (JP) ..... JP2020-016143

(51) Int. Cl.
*B67D 7/64* (2010.01)

(52) U.S. Cl.
CPC ..... *B67D 7/645* (2013.01)

(58) Field of Classification Search
CPC ..... B67D 7/645; F04B 15/02; F04B 23/028; F04B 53/06
See application file for complete search history.

(56) References Cited

U.S. PATENT DOCUMENTS 2,221,763 A * 11/1940 Ginter ..... F16N 13/16 417/264
2,630,248 A * 3/1953 Hinz ..... B67D 7/0227 222/320
3,719,437 A * 3/1973 Schuhmann ..... F04B 53/00 417/489

(Continued)

FOREIGN PATENT DOCUMENTS

JP 2018-127905 A 8/2018
JP 2019-183749 A 10/2019

*Primary Examiner* — Donnell A Long
(74) *Attorney, Agent, or Firm* — Oblon, McClelland, Maier & Neustadt, L.L.P.

(57) ABSTRACT

A fluid pressure feeding device includes: a follower plate that is inserted into a tank, that applies a pressing force to a fluid, and that has an opening for pumping up the fluid from an inside of the tank; a pump having a primer plate configured to exhibit reciprocating movement to pump up the fluid in the tank into a pump internal space; and a position control unit configured to control a position of the primer plate within a range of the reciprocating movement. An outer shape of the primer plate substantially matches a shape of the opening of the follower plate, and the position control unit is configured such that the primer plate is positioned in the opening of the follower plate when the follower plate is taken out from the tank.

7 Claims, 14 Drawing Sheets

(56) References Cited

U.S. PATENT DOCUMENTS

| | | | | |
|---|---|---|---|---|
| 4,450,860 | A * | 5/1984 | Francis | F16K 15/025 137/543.19 |
| 4,630,760 | A * | 12/1986 | Wold | B67D 7/70 222/387 |
| 4,875,833 | A * | 10/1989 | Canaud | F04B 15/02 417/489 |
| 4,957,572 | A * | 9/1990 | Dewitte | B29C 48/48 118/302 |
| 10,518,988 | B1 | 12/2019 | Hryckowian | |
| 2007/0039978 | A1 | 2/2007 | Scheugenpflug | |
| 2019/0184615 | A1* | 6/2019 | Gerke | B29C 45/1808 |
| 2019/0314858 | A1 | 10/2019 | Tasaka et al. | |

* cited by examiner

FLUID PRESSURE FEEDING DEVICE

CROSS-REFERENCE TO RELATED APPLICATION

This application claims priority to Japanese Patent Application No. 2020-016143 filed on Feb. 3, 2020, incorporated herein by reference in its entirety.

BACKGROUND

1. Technical Field

The disclosure relates to a fluid pressure feeding device that pressure-feeds a viscous fluid (hereinafter also simply referred to as "fluid") such as an adhesive stored in a tank toward a workpiece in a vehicle manufacturing line or the like.

2. Description of Related Art

As disclosed in Japanese Unexamined Patent Application Publication No. 2018-127905 (JP 2018-127905 A), there is known a fluid pressure feeding device for pressure-feeding a fluid (viscous fluid) such as an adhesive from a tank (drum can) toward a workpiece, in order to apply the fluid to the workpiece in a vehicle manufacturing line.

FIG. 13 is a sectional view showing a part of a fluid pressure feeding device a in the related art. As shown in FIG. 13, the fluid pressure feeding device a has a follower plate d that applies a pressing force to a fluid c in a tank b from above. The follower plate d is supported by an elevator e so as to be elevated and lowered. The follower plate d has, on its outer periphery, seal hoses h for securing sealing properties between the follower plate d and the inner surface of the tank b. Further, a drum pump g connected to a fluid path (not shown) is attached to the center of the upper surface of the follower plate d. The drum pump g communicates with an opening f provided in the center of the follower plate d and has a primer plate i that is movable up and down (between the inside of the tank b and the inside of the drum pump g). The up and down movement of the primer plate i pumps up the fluid c in the tank b into the drum pump g.

In the pressure feeding operation of the fluid c to the fluid path, the follower plate d is moved downward to apply downward pressing force to the fluid c in the tank b, and the drum pump g is operated to move the primer plate i up and down, whereby the fluid c in the tank b is pumped up into the drum pump g through the opening f of the follower plate d, and pressure-fed to the fluid path with the flow rate adjusted. The fluid path is connected to a coating robot (not shown), and the fluid c that has reached the coating robot is applied from the discharge port of the coating robot toward the workpiece.

SUMMARY

When the remaining amount of the fluid c in the tank b becomes small, the tank b needs to be replaced. The virtual line in FIG. 13 shows a state in which the follower plate d reaches the vicinity of the bottom of the tank b with a small remaining amount of the fluid c in the tank b, and the tank b needs to be replaced.

The replacement operation of the tank b requires operations such as taking out the follower plate d from the inside of the tank b, removing the fluid c adhering to the follower plate d, carrying out the empty tank b, carrying in a new tank (a tank filled with the fluid c) b, inserting the follower plate d into the new tank b, and bleeding air from the inside of the tank b.

FIG. 14 is a sectional view showing the follower plate d and a part of the drum pump g that are taken out from the inside of the tank b in the replacement operation of the tank b.

Generally, as shown in FIG. 14, when the follower plate d is taken out from the inside of the tank b, the primer plate i of the drum pump g is pulled in (moved upward) from the follower plate d. That is, the primer plate i is positioned at the uppermost position (hereinafter also referred to as "top dead center") in the reciprocating range (moving stroke). The movement of the primer plate i to the top dead center is performed by an operator's manual operation (switch operation of the operation panel of the fluid pressure feeding device a, or the like).

In such a state, air enters the inside of the drum pump g (the region below the primer plate i, namely a region A in FIG. 14) and the inside of the opening f of the follower plate d.

FIGS. 15A-15E are diagrams illustrating the situation where the air enters. From the state shown in FIG. 15A (the state where the follower plate d has reached the vicinity of the bottom of the tank b and the tank b needs to be replaced), the follower plate d is elevated as shown in FIG. 15B. Then, due to the viscosity of the fluid c, the fluid c inside the drum pump g (the fluid c below the primer plate i at the top dead center) is dragged on the tank b side, whereby air k may enter the inside of the drum pump g and the inside of the opening f of the follower plated (see FIGS. 15B and 15C). In this state, as shown in FIG. 15D, the follower plate d is inserted into the new tank b, and even when the air k is bled from an air bleeding hole j provided in the follower plate d, the air k may remain as shown in FIG. 15E. One of the reasons why the air k remains is, the fluid c is present between the inside of the drum pump g or the inside of the opening f of the follower plate d and the air bleeding hole j, whereby the region in which the air k is present is a space closed by the fluid c (the air k does not communicate with the air bleeding hole j).

In the state where the air k remains in this way, when the device is restarted after the replacement operation of the tank b, air may be sent to the coating robot via the drum pump g and the fluid path, and the air may be ejected from the discharge port of the coating robot, which may hinder the application operation of the fluid c. Therefore, before the restart, the drum pump g needs to be operated until the remaining air k is discharged (so-called blank pumping of the drum pump g is performed), causing a large amount of waste of the fluid.

The disclosure provides a fluid pressure feeding device capable of reducing the amount of fluid waste associated with a replacement operation of the tank.

An aspect of the disclosure relates to a fluid pressure feeding device. The fluid pressure feeding device includes: a follower plate that is inserted into a tank storing a fluid, that applies a pressing force to the fluid, and that has an opening for pumping up the fluid from an inside of the tank; a pump having a pump internal space communicating with the opening of the follower plate and having a primer plate configured to exhibit reciprocating movement between the inside of the tank and the pump internal space to pump up the fluid in the tank into the pump internal space; and a position control unit configured to control a position of the primer plate within a range of the reciprocating movement. An outer shape of the primer plate substantially matches a shape of the opening of the follower plate, and the position control unit is configured such that the primer plate is positioned in the opening of the follower plate when the follower plate is taken out from the tank.

According to the above aspect, when the follower plate is taken out from the tank, the position control unit controls the position of the primer plate to position the primer plate in the opening of the follower plate. As a result, the opening of the follower plate is substantially closed by the primer plate, and even when the follower plate is taken out from the tank, the state where the pump internal space and the entire inside of the opening of the follower plate (hereinafter also referred to as "pump internal space or the like") are filled with the fluid is maintained. That is, it is possible to suppress a situation where the fluid flows out from the pump internal space or the like and air enters the pump internal space or the like when the follower plate is taken out from the tank. This eliminates the need to perform so-called blank pumping of the pump (operation of operating the pump until the air remaining in the pump internal space or the like is discharged) before restarting the fluid pressure feeding device after the replacement operation of the tank, and it is thus possible to reduce the amount of waste of the fluid associated with the replacement operation of the tank.

In the above aspect, the fluid pressure feeding device may further include: an air motor serving as a power source for causing the reciprocating movement of the primer plate; and a switching valve configured to switch between supply and non-supply of air to the air motor. The position control unit may be configured to switch the switching valve, such that in taking out the follower plate from the tank, to supply air to the air motor to move the primer plate toward the opening of the follower plate, and when the primer plate reaches the opening of the follower plate, to block air supply to the air motor.

According to the above configuration, since the primer plate can be positioned in the opening of the follower plate by the switching operation of the switching valve when the follower plate is taken out from the tank, it is possible to realize an operation capable of reducing the amount of waste of the fluid associated with the replacement operation of the tank with a relatively inexpensive configuration.

In the above aspect, the follower plate (3) may be provided with an air bleeding hole (38) that is for air in the tank (2) being discharged. An end surface of the primer plate facing the tank in a state where the primer plate is positioned in the opening of the follower plate may have a curved surface shape that protrudes toward the tank toward a center of the end surface.

According to the above configuration, when the follower plate is inserted into a new tank after replacement, the air in the tank can be discharged to the outside of the tank from the air bleeding hole without remaining in the vicinity of the end surface of the primer plate. This also eliminates the need to perform the so-called blank pumping of the pump before restarting the fluid pressure feeding device after the replacement operation of the tank, and the amount of waste of the fluid associated with the tank replacement operation can be reduced.

In the above aspect, when the primer plate reaches the opening of the follower plate, a gap between an outer peripheral surface of the primer plate and an inner peripheral surface of the opening of the follower plate may be a gap such that the fluid inside the opening of the follower plate does not flow down.

According to the above aspect, the position control unit capable of controlling the position the primer plate that reciprocates between the inside of the tank and the pump internal space to pump up the fluid in the tank to the pump internal space is provided so that when the follower plate is taken out from the tank, the position control unit positions the primer plate in the opening of the follower plate. Therefore, it is possible to suppress the situation where the fluid flows out from the pump internal space and the inside of the opening of the follower plate, and air enters the pump internal space and the inside of the opening of the follower plate when the follower plate is taken out from the tank, which eliminates the need to perform the so-called blank pumping of the pump before restarting the fluid pressure feeding device after the replacement operation of the tank, and thus reduces the amount of waste of the fluid associated with the replacement operation of the tank.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

An embodiment of the disclosure will be described below with reference to the drawings. The present embodiment describes a case where the disclosure is applied to a fluid pressure feeding device for pressure-feeding a urethane adhesive (adhesive for adhering a window glass to a vehicle body, hereinafter referred to as a "fluid") that is applied to a window glass, which is a workpiece, toward a coating robot in a vehicle manufacturing line.

Configuration of Fluid Pressure Feeding Device

Figure 1:
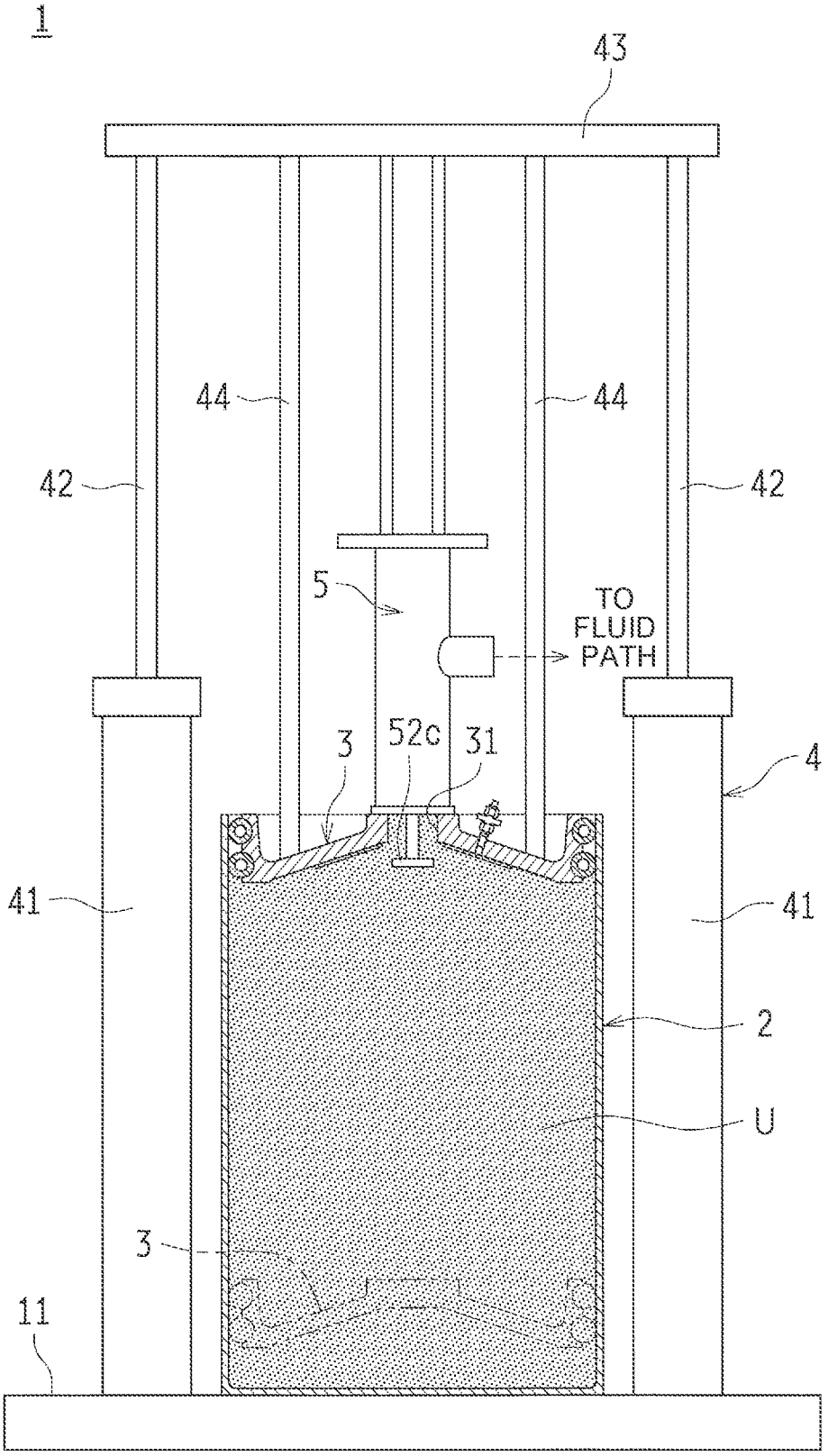
FIG. 1 is a sectional view showing a part of a fluid pressure feeding device according to an embodiment.

FIG. 1 is a sectional view showing a part of a fluid pressure feeding device 1 according to the present embodiment. As shown in FIG. 1, the fluid pressure feeding device 1 is configured to include a tank 2, a follower plate 3, an elevator 4, a drum pump 5, and the like.

An outline of the pressure feeding operation of a urethane adhesive U in the fluid pressure feeding device 1 is as follows. As shown in FIG. 1, with the urethane adhesive U stored in the tank 2, the urethane adhesive U is pressed from above by the follower plate 3, and while the urethane adhesive U is pushed out toward the drum pump 5 through the opening 31 provided in the center of the follower plate 3, a predetermined amount (the amount required by a coating robot (not shown)) of the urethane adhesive U is pressure-fed by the drum pump 5 toward the coating robot through a fluid path.

Hereinafter, components constituting the fluid pressure feeding device 1 will be described.

The tank 2 is a drum can in which the urethane adhesive U is stored (filled), and is replaced when the remaining amount of the urethane adhesive U in the tank 2 is small. In the fluid pressure feeding device 1, cylinders 41, 41 of the elevator 4 are disposed on a base plate 11, and the tank 2 is disposed between the cylinders 41, 41. The cylinders 41, 41 are composed of air cylinders and their piston rods 42, 42 extend upward. The upper ends of the piston rods 42, 42 are attached to a tie bar 43 extending in the horizontal direction.

An upper portion of the tank 2 is open, and the open portion of the tank 2 is closed by the follower plate 3. Tie rods 44, 44 connect the upper surface of the follower plate 3 and the tie bar 43.

With this configuration, when the tie bar 43 is elevated and lowered by the operation of the cylinders 41, 41, the follower plate 3 connected to the tie bar 43 via the tie rods 44, 44 is also elevated and lowered accordingly. By the operation of the cylinders 41, 41, the follower plate 3 applies a pressing force to the urethane adhesive U in the tank 2 from above. Due to this pressing force, the urethane adhesive U in the tank 2 is pushed out to the drum pump 5 through the opening 31 provided in the follower plate 3. As the urethane adhesive U is pushed out from the inside of the tank 2, the remaining amount of the urethane adhesive U in the tank 2 decreases. Accordingly, the follower plate 3 descends inside the tank 2.

Regarding a range of elevating and lowering the tie bar 43 by the operation of the cylinders 41, 41, when the tie bar 43 is at the highest position, the follower plate 3 is positioned above the upper end of the tank 2 by a predetermined dimension. Thus, the follower plate 3 is retracted from the upper end of the tank 2 so that the tank 2 can be replaced (the tank 2 can be carried out and a new tank 2 can be carried in). When the tie bar 43 is at the lowest position, the follower plate 3 is in a position where it reaches the vicinity of the bottom of the tank 2 (see the virtual line in FIG. 1).

The follower plate 3 closes the open portion of the upper portion of the tank 2 as described above. In this state, the follower plate 3 applies a pressing force to the urethane adhesive U in the tank 2 from above. This pressing force acts as a force for pushing the urethane adhesive U in the tank 2 toward the drum pump 5. The applied pressing force is set to a value that does not open a check valve 53 of the drum pump 5 described later.

Figure 2:
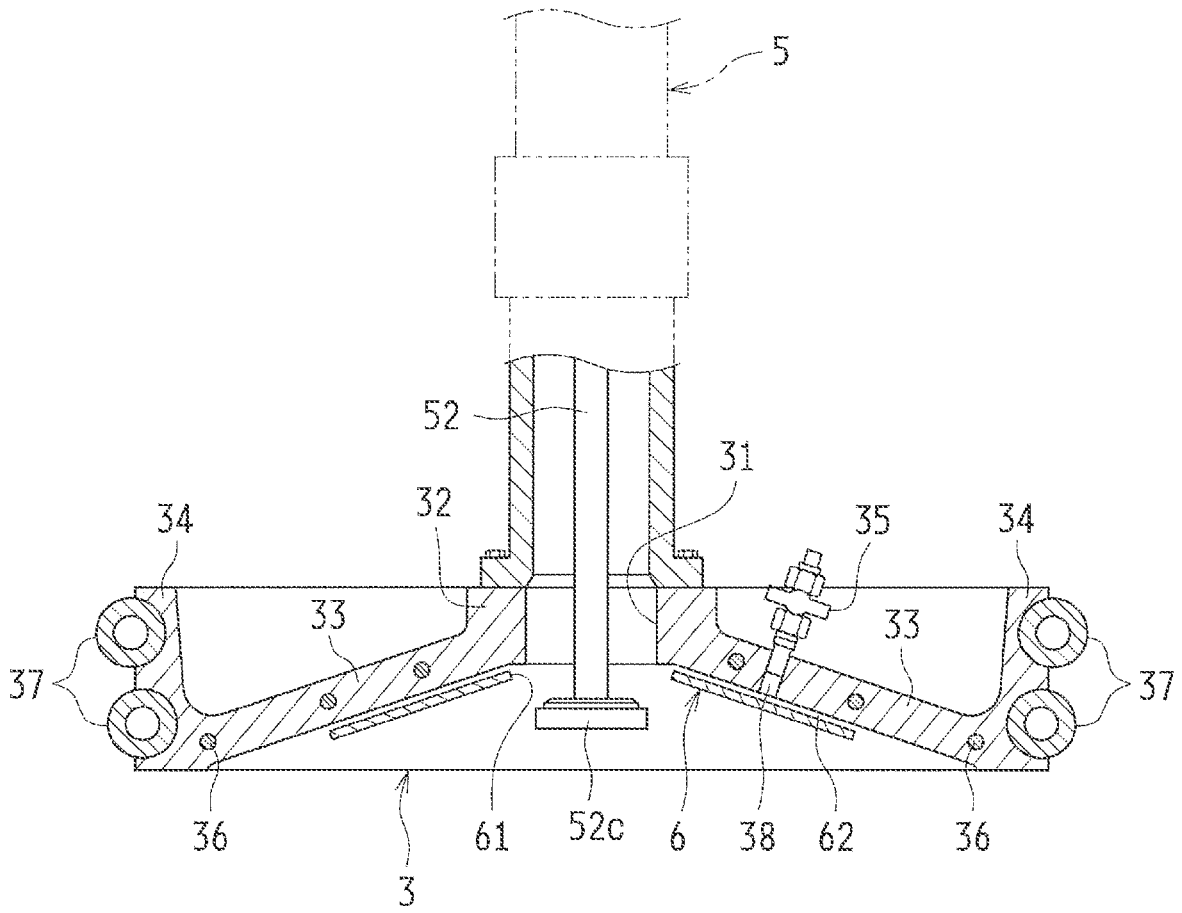
FIG. 2 is a sectional view showing a follower plate and its periphery.

FIG. 2 is a sectional view showing the follower plate 3 and its periphery. As shown in FIG. 2, the follower plate 3 integrally has a cylindrical central portion 32 to which the drum pump 5 is bolted, an inclined plate portion 33 that inclines diagonally downward from the outer periphery of the central portion 32 toward the outside, and an outer edge portion 34 extending upward by a predetermined dimension from the outer peripheral edge of the inclined plate portion 33.

An air bleeding hole 38 is provided in the inclined plate portion 33 of the follower plate 3, and an air bleeding plug 35 is mounted on the air bleeding hole 38. The air bleeding plug 35 can be opened and closed by, for example, manual operation. When the air bleeding plug 35 is opened, the space below the follower plate 3 and the space above the follower plate 3 communicate with each other through the air bleeding hole 38. Thus, when the air bleeding plug 35 is opened with the follower plate 3 inserted into the tank 2, the internal space of the tank 2 is communicated with the atmosphere. Further, when the air bleeding plug 35 is closed, communication between the space below the follower plate 3 and the space above the follower plate 3 is blocked. Thus, when the follower plate 3 is inserted into the tank 2 and the air bleeding plug 35 is closed, communication between the internal space of the tank 2 and the atmosphere is blocked. The air bleeding hole 38 is provided in a plurality of positions in the inclined plate portion 33 of the follower plate 3 in the circumferential direction. Further, a vacuum pump (not shown) is connected to the air bleeding plug 35, and the air in the tank 2 is vacuumed by the operation of the vacuum pump in the air bleeding operation at the time of the replacement operation of the tank described later.

Further, an electric heater 36 is embedded in the inclined plate portion 33 of the follower plate 3 to suppress hardening of the urethane adhesive U. Two seal hoses 37, 37 are attached to the outer peripheral surface of the outer edge portion 34 of the follower plate 3 in the circumferential direction of the follower plate 3. The seal hoses 37, 37 are for securing sealing properties between the outer peripheral edge of the follower plate 3 and the inner surface of the tank 2.

An auxiliary plate 6 is mounted on the lower surface of the inclined plate portion 33 of the follower plate 3. The auxiliary plate 6 is made of a substantially conical plate material, and an opening 61 is provided at the top thereof. The opening 61 faces the opening 31 of the follower plate 3. The upper surface of the auxiliary plate 6 is inclined so as to substantially correspond to the lower surface of the inclined plate portion 33 of the follower plate 3. The auxiliary plate 6 is mounted on the follower plate 3 with a magnet (not shown) provided on the lower surface of the follower plate 3. A communication path 62 is provided between the lower surface of the inclined plate portion 33 of the follower plate 3 and the upper surface of the auxiliary plate 6 for guiding the air existing in the tank 2 to the air bleeding hole 38 of the follower plate 3 at the time of the air bleeding operation described later (the air bleeding operation using this communication path 62 will be described later).

The drum pump 5 takes out the urethane adhesive U stored in the tank 2 and pressure-feeds a predetermined amount of the urethane adhesive U toward a coating robot through a fluid path.

Figure 3:
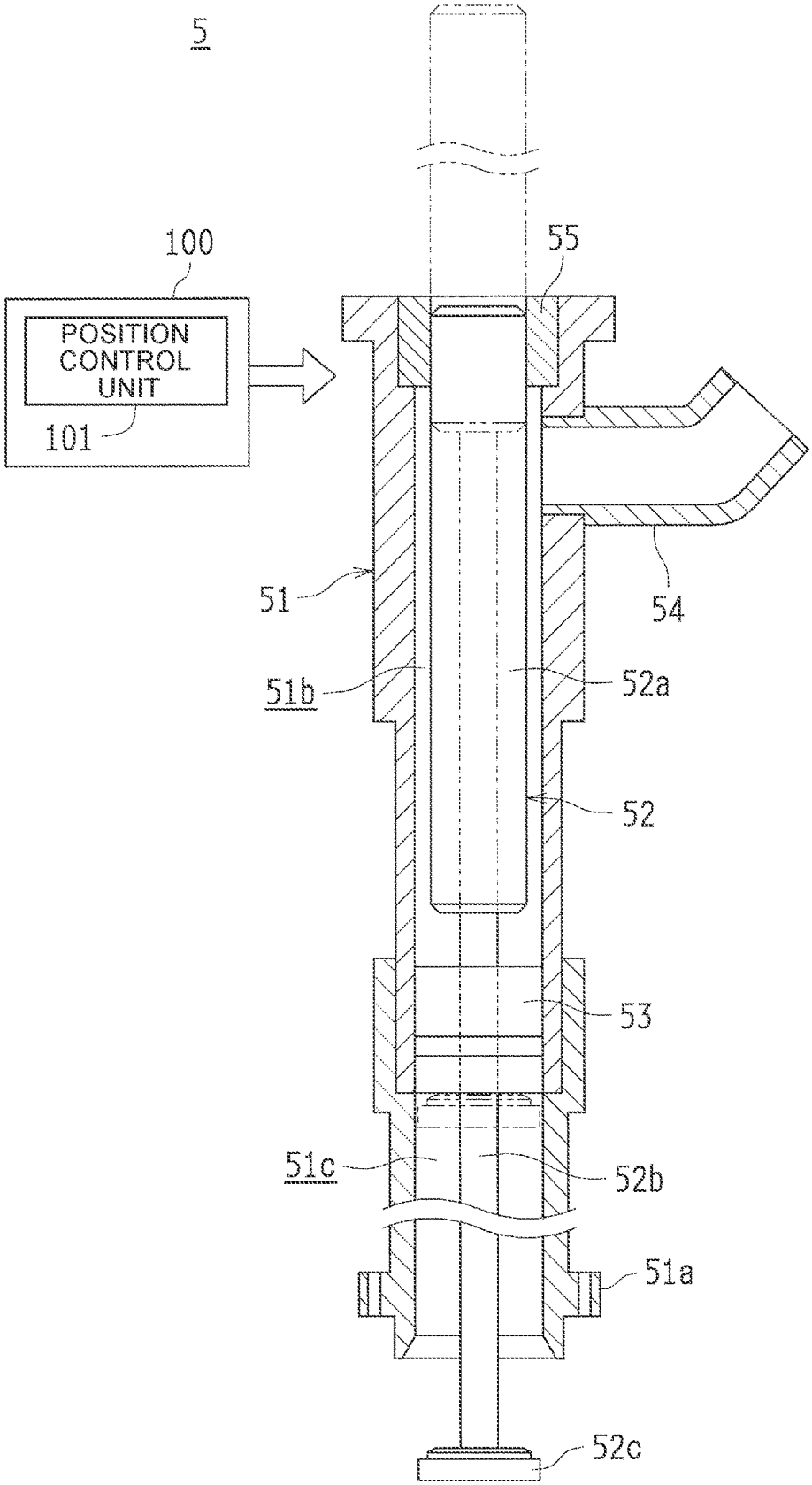
FIG. 3 is a sectional view of a drum pump.
Figure 4:
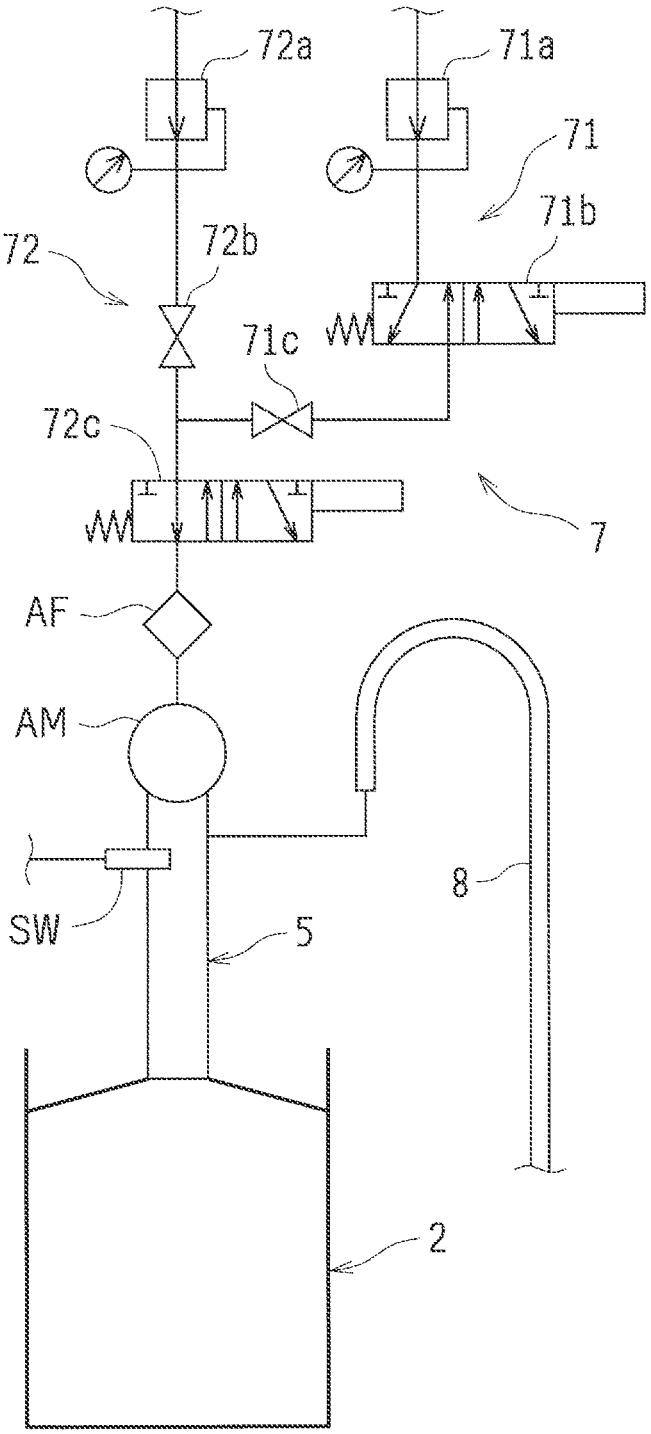
FIG. 4 is a diagram showing a schematic configuration of an air supply circuit that operates an air motor of the drum pump.

FIG. 3 is a sectional view of the drum pump 5. FIG. 4 is a diagram showing a schematic configuration of an air supply circuit 7 that operates an air motor AM provided in the drum pump 5. As shown in FIG. 3, the drum pump 5 is configured by inserting a pump rod 52 into a pump casing 51 such that the pump rod 52 is reciprocally movable with respect to the pump casing 51.

A flange 51*a* for attaching the drum pump 5 to the follower plate 3 is provided in the lower portion of the pump casing 51, and the flange 51*a* is bolted to the central portion 32 of the follower plate 3. As a result, the inside of the pump casing 51 and the inside of the tank 2 communicate with each other via the follower plate 3 (via the opening 31 of the central portion 32 of the follower plate 3).

A check valve 53 is provided inside the pump casing 51, and the inside of the pump casing 51 is partitioned into an upper space 51*b* and a lower space 51*c* by the check valve 53. The check valve 53 opens and closes based on the pressure difference between the upper space 51*b* and the lower space 51*c* (the "pump internal space" in the disclosure). Specifically, when the pressure in the lower space 51*c* becomes higher than the pressure in the upper space 51*b* by a predetermined value, the check valve 53 is opened so that the urethane adhesive U flows from the lower space 51*c* into the upper space 51*b*. On the other hand, when the pressure in the upper space 51*b* is higher than the pressure in the lower space 51*c*, or when the pressure in the lower space 51*c* is higher than the pressure in the upper space 51*b* but the difference in the pressures is less than the predetermined value, the check valve 53 is closed so that the urethane adhesive U does not flow between the upper space 51*b* and the lower space 51*c*. An adhesive guide pipe 54 that communicates with the upper space 51*b* is connected to the pump casing 51. A packing seal nut 55 that seals the space between the pump casing 51 and the pump rod 52 is mounted on the upper portion of the pump casing 51.

The pump rod 52 has a large diameter portion 52*a* that is located in the upper space 51*b* and that has a slightly smaller diameter than the inner diameter of the upper space 51*b*, and a small diameter portion 52*b* that is inserted into the check valve 53 and that has a smaller outer diameter than the large diameter portion 52*a*. The pump rod 52 can be elevated and lowered (moved up and down) inside the pump casing 51 by the operation of the air motor AM (see FIG. 4).

A disc-shaped primer plate 52*c* is attached to the lower end of the small diameter portion 52*b*. The outer diameter of the primer plate 52*c* and the inner diameter of the lower space 51*c* of the pump casing 51 are substantially the same. Thus, when the pump rod 52 is elevated and the primer plate 52*c* is located in the lower space 51*c*, the lower portion of the lower space 51*c* is closed.

Figure 5:
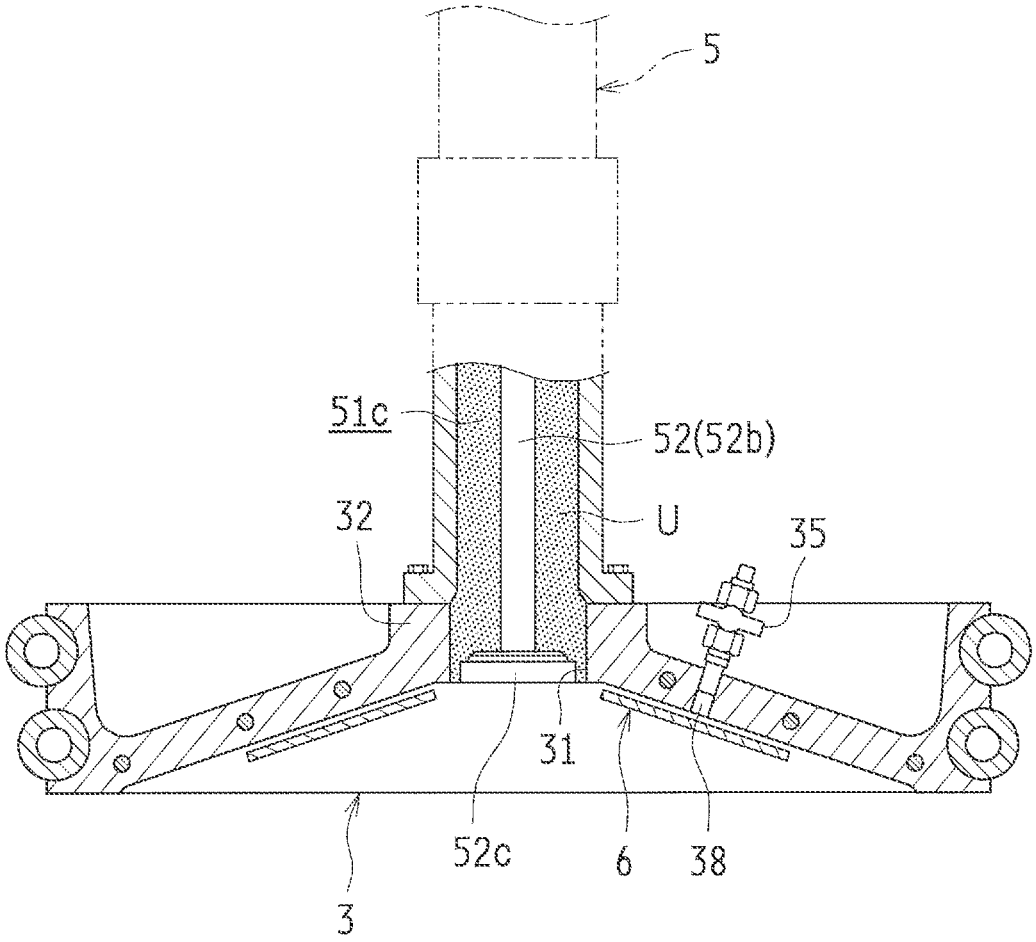
FIG. 5 is a sectional view showing the follower plate and a part of the drum pump that are taken out from the inside of a tank in a replacement operation of the tank.

The outer diameter of the primer plate 52*c* is slightly smaller than the inner diameter of the opening (circular opening) 31 of the follower plate 3. That is, the gap of the outer diameter of the primer plate 52*c* and the inner diameter of the opening 31 of the follower plate 3 is small, so that the outer shape of the primer plate 52*c* matches (substantially matches) the shape of the opening 31 of the follower plate 3. Thus, as shown in FIG. 5, when the primer plate 52*c* is located at the opening 31 of the follower plate 3 with the movement of the pump rod 52, the opening 31 is substantially closed by the primer plate 52*c*. Technically, there is a slight gap between the outer peripheral surface of the primer plate 52*c* and the inner peripheral surface of the opening 31 of the follower plate 3.

Since the drum pump 5 is configured in this way, in a state where the pump rod 52 is elevated and the primer plate 52*c* is located in the lower space 51*c*, when the pump rod 52 is further elevated and the space between the primer plate 52*c* and the check valve 53 becomes smaller, the pressure in this space increases, and at the point where the difference between this pressure and the pressure in the upper space 51*b* reaches the predetermined value, the check valve 53 opens and the urethane adhesive U flows into the upper space 51*b*.

Then, as shown by the virtual line in FIG. 3, when the pump rod 52 is elevated until the primer plate 52*c* reaches the vicinity of the check valve 53, a large part of the large diameter portion 52*a* of the pump rod 52 protrudes upward from the pump casing 51, and the small diameter portion 52*b* is present in a large part of the upper space 51*b* of the pump casing 51. In this state, since the space between the inner peripheral surface of the pump casing 51 and the outer peripheral surface of the small diameter portion 52*b* in the upper space 51*b* is relatively large, a relatively large amount of the urethane adhesive U is present in (has flown into) the upper space 51*b*.

When the pump rod 52 is lowered from this state, the large diameter portion 52*a* of the pump rod 52 enters the upper space 51*b* of the pump casing 51. Thus, the urethane adhesive U is pushed out toward the adhesive guide pipe 54 by the difference between the volume of the small diameter portion 52*b* that has moved from the upper space 51*b* to the lower space 51*c* and the volume of the large diameter portion 52*a* that has entered the upper space 51*b*. In other words, by adjusting the lowered amount of the pump rod 52, the amount of the urethane adhesive U pushed out from the pump casing 51 can be adjusted, and the amount of the urethane adhesive U pressure-fed toward the coating robot through the fluid path can be adjusted.

Here, the schematic configuration of the air supply circuit 7 that operates the air motor AM that elevates and lowers the pump rod 52 inside the pump casing 51 will be described. As shown in FIG. 4, a first air supply circuit 71 and a second air supply circuit 72 are connected to the air motor AM attached to the upper portion of the pump casing 51.

The first air supply circuit 71 switches between supply and non-supply of air to the air motor AM when performing a pumping operation of the urethane adhesive U to the lower space 51*c* or a pressure feeding operation of the urethane adhesive U to the coating robot via the fluid path. On the other hand, the second air supply circuit 72 switches between supply and non-supply of air to the air motor AM in order to adjust the position of the pump rod 52 (adjust the position of the primer plate 52*c* such that the opening 31 is substantially closed by the primer plate 52*c*) when replacing the tank 2.

Specifically, the first air supply circuit 71 is a known circuit that includes a check valve 71*a*, a first air supply switching valve 71*b* that is a solenoid two-position directional control valve, and a gate valve 71*c*. When the first air supply switching valve 71*b* is in the non-excitation position (the position moved to the right in FIG. 4), the air supplied from an air pump (not shown) is discharged so that the air is not supplied to the air motor AM. On the other hand, when the first air supply switching valve 71*b* is switched to the excitation position (the position moved to the left in FIG. 4)

while a second air supply switching valve 72*c* described later is in the position shown in FIG. 4, the air supplied from the air pump is supplied to the air motor AM, and the pump rod 52 is elevated and lowered by the operation of the air motor AM. By such a switching operation of the first air supply switching valve 71*b*, a pumping operation of the urethane adhesive U to the lower space 51*c* and a pressure feeding operation of the urethane adhesive U to the coating robot via the fluid path described above are performed. Since the specific configuration of the air motor AM and the mechanism for elevating and lowering the pump rod 52 by the operation of the air motor AM are known, the description thereof is omitted here.

On the other hand, the second air supply circuit 72 includes a check valve 72*a*, a gate valve 72*b*, and the second air supply switching valve 72*c* that is a solenoid two-position directional control valve. The first air supply switching valve 71*b* is connected to the air pipe between the gate valve 72*b* and the second air supply switching valve 72*c* via a pipe. An air filter AF is interposed between the second air supply switching valve 72*c* and the air motor AM. When the second air supply switching valve 72*c* is in the excitation position (the position moved to the left in FIG. 4) while the first air supply switching valve 71*b* is in the position shown in FIG. 4, the air supplied from the air pump is discharged so that the air is not supplied to the air motor AM. On the other hand, when the second air supply switching valve 72*c* is switched to the non-excitation position (the position moved to the right in FIG. 4), the air supplied from the air pump is supplied to the air motor AM, and the pump rod 52 is elevated and lowered by the operation of the air motor AM.

The drum pump 5 has a proximity switch SW for detecting the elevating position of the pump rod 52 and thereby estimating that the primer plate 52*c* has reached the position where it substantially closes the opening 31. This proximity switch SW detects a specific portion of the pump rod 52 that is elevated and lowered in the pump casing 51, and transmits a detection signal to a controller 100 (see FIG. 3) described later at the point where the position of the specific portion has reached a position corresponding to the position where the primer plate 52*c* substantially closes the opening 31 when the tank 2 is replaced.

Therefore, when the tank 2 is replaced, the detection signal is transmitted from the proximity switch SW, when the elevating position of the pump rod 52 reaches a position corresponding to the position where the opening 31 is substantially closed by the primer plate 52*c*, and accordingly the second air supply switching valve 72*c* is switched and the air motor AM is stopped, whereby the opening 31 is substantially closed by the primer plate 52*c*.

The operation of the first air supply switching valve 71*b* described above is performed as follows. The controller 100 receives the information on the amount of the urethane adhesive U required by the coating robot, and the controller 100 performs the switching operation of the first air supply switching valve 71*b*, thereby adjusting the lowered amount of the pump rod 52. Further, the operation of the second air supply switching valve 72*c* described above is performed as follows. The controller 100 receives the replacement request information of the tank 2, and the controller 100 performs the switching operation of the second air supply switching valve 72*c*, thereby stopping the pump rod 52 at a position corresponding to the position where the opening 31 is substantially closed by the primer plate 52*c*. As described above, by providing the second air supply switching valve 72*c* for stopping the pump rod 52 at a position corresponding to the position where the opening 31 is substantially closed by the primer plate 52*c*, it is possible to substantially close the opening 31 by the primer plate 52*c* with a relatively inexpensive configuration.

Thus, the controller 100 is provided with a position control unit 101 as a functional unit that adjusts the position of the pump rod 52. The position control unit 101 not only adjusts the position of the pump rod 52 for adjusting the pressure-feeding amount of the urethane adhesive U described above, but also adjusts the position of the pump rod 52 (position of the primer plate 52*c*) when the tank 2 is replaced.

The fluid path is configured to have a flexible pipe 8 so that the urethane adhesive U can be favorably pressure-fed even when the drum pump 5 is elevated and lowered as the follower plate 3 is elevated and lowered.

Operation of Fluid Pressure Feeding Device

Next, the operation of the fluid pressure feeding device 1 configured as described above will be described. FIG. 1 shows a state in which the tank 2 is fully filled with the urethane adhesive U. When the pressure-feeding of the urethane adhesive U is started from this state, the tie bar 43 is lowered by the operation of the cylinders 41, 41 of the elevator 4, whereby the follower plate 3 applies pressing force to the urethane adhesive U in the tank 2 from above. Due to this pressing force, a part of the urethane adhesive U in the tank 2 flows toward the drum pump 5.

Meanwhile, the pump rod 52 of the drum pump 5 pumps up the urethane adhesive U in the tank 2 to the lower space Mc of the drum pump 5 by moving the primer plate 52*c* up and down. In a state where the primer plate 52*c* is located in the lower space 51*c* by the elevation of the primer plate 52*c*, when the pump rod 52 is further elevated and the space between the primer plate 52*c* and the check valve 53 becomes smaller, the pressure in this space increases, and at the point where the difference between this pressure and the pressure in the upper space 51*b* reaches the predetermined value, the check valve 53 opens and the urethane adhesive U flows into the upper space 51*b*. Subsequently, when the pump rod 52 is lowered, the urethane adhesive U is pushed out from the pump casing 51 to the adhesive guide pipe 54 by a predetermined amount based on the lowered amount, and the urethane adhesive U is pressure-fed toward the coating robot through the fluid path. The urethane adhesive U is applied to the window glass by the coating robot. The lowering of the pump rod 52 (the operation of pushing out the urethane adhesive U from the pump casing 51 to the adhesive guide pipe 54) is performed intermittently every time the application operation of the urethane adhesive U to the window glass is performed.

As the inflow operation of the urethane adhesive U from the tank 2 to the drum pump 5 and the pressure-feeding operation of the urethane adhesive U to the fluid path by the drum pump 5 are continued, the urethane adhesive U in the tank 2 is consumed. Along with this, the remaining amount of the urethane adhesive U in the tank 2 decreases, so that the follower plate 3 descends in the tank 2.

When the follower plate 3 reaches the vicinity of the bottom of the tank 2 as shown by the virtual line in FIG. 1, the tank 2 needs to be replaced. The elevating position of the tie bar 43 is sensed by a sensor (not shown). When the elevating position of the tie bar 43 reaches a predetermined position (a position where the follower plate 3 reaches the vicinity of the bottom of the tank 2), information for urging the operator to replace the tank 2 is transmitted to the operator. For example, lighting of a lamp provided on an operation panel (not shown), sound transmission, and the like are performed.

Replacement Operation of Tank

Next, the operation of replacing the tank 2 will be described. As the operation for replacing the tank 2, first, the operation of taking out the follower plate 3 that has reached the vicinity of the bottom of the tank 2 from the tank 2 is performed. In this operation, the air bleeding plug 35 is opened, and the cylinders 41, 41 of the elevator 4 are operated in a state where the internal space of the tank 2 is communicated with the atmosphere through the air bleeding hole 38 to pull up the follower plate 3. At this time, air flows into the tank 2 through the air bleeding hole 38, so that the follower plate 3 can be easily pulled up.

The feature of the present embodiment resides in the position control of the primer plate 52*c* when the operation of taking out the follower plate 3 from the tank 2 is performed. As described above, the position of the primer plate 52*c* is controlled by the position control unit 101 provided in the controller 100. Specifically, when the operation of taking out the follower plate 3 from the tank 2 is performed, the position control unit 101 controls the switching of the second air supply switching valve 72*c* to adjust the position of the pump rod 52, and positions the primer plate 52*c* in the opening 31 of the follower plate 3 (see FIG. 5). For example, the position of the primer plate 52*c* is adjusted so that the lower surface of the primer plate 52*c* and the lower surface of the central portion 32 of the follower plate 3 are flush with each other. Thus, the opening 31 of the follower plate 3 is substantially closed by the primer plate 52*c*.

Figure 6:
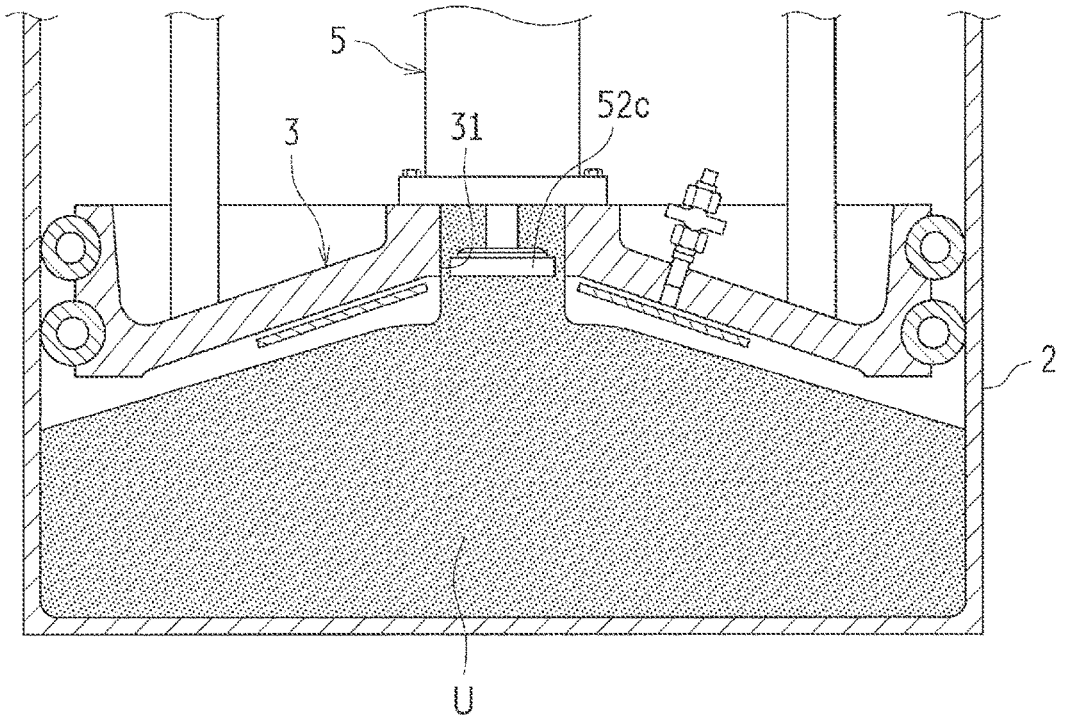
FIG. 6 is a sectional view showing a state at the start of taking out the follower plate from the inside of the tank in the replacement operation of the tank.

FIG. 6 is a sectional view showing a state at the start of taking out the follower plate 3 from the inside of the tank 2 in the replacement operation of the tank 2. As shown in FIG. 6, the primer plate 52*c* is positioned in the opening 31 of the follower plate 3, and the follower plate 3 is to be taken out with the opening 31 of the follower plate 3 being substantially closed by the primer plate 52*c*.

Figure 7:
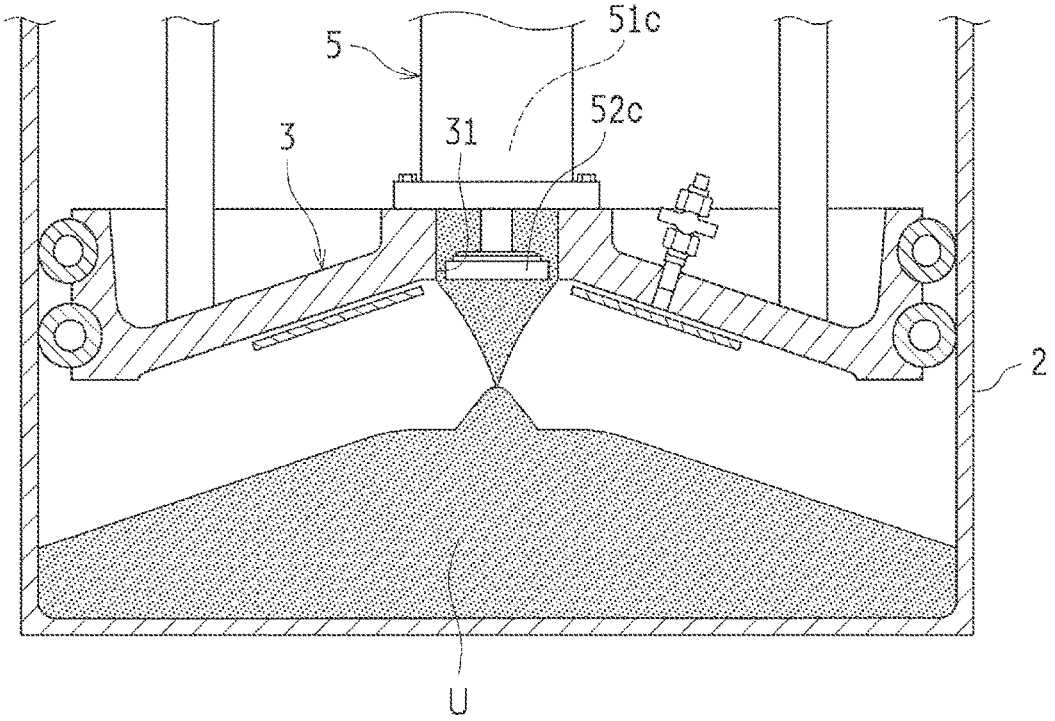
FIG. 7 is a sectional view showing a state in which the follower plate is elevated to a predetermined position in the tank in the replacement operation of the tank.

Then, as shown in FIG. 7, when the follower plate 3 is elevated to a predetermined position in the tank 2, the follower plate 3 is elevated with a part of the urethane adhesive U remaining in the tank 2 adhered to the lower surface of the primer plate 52*c* due to the viscosity of the urethane adhesive U. Since the opening 31 of the follower plate 3 is substantially closed by the primer plate 52*c*, the situation where the urethane adhesive U in the lower space 51*c* of the drum pump 5 and the urethane adhesive U inside the opening 31 of the follower plate 3 are dragged on the tank 2 side does not occur, and air is restrained from entering the lower space 51*c* of the drum pump 5 and the inside of the opening 31 of the follower plate 3.

As described above, in the state where the opening 31 of the follower plate 3 is substantially closed by the primer plate 52*c*, there is a slight gap between the outer peripheral surface of the primer plate 52*c* and the inner peripheral surface of the opening 31 of the follower plate 3. This gap is set so that the urethane adhesive U does not flow down due to the viscosity of the urethane adhesive U. That is, the higher the viscosity of the urethane adhesive U, the larger the allowable range for increasing the gap. This gap (a gap determined based on the outer diameter dimension of the primer plate 52*c*) is determined in advance by experiment or simulation in consideration of the viscosity of the urethane adhesive U.

Therefore, even if the follower plate 3 is further elevated in this state, the state where the lower space 51*c* of the drum pump 5 and the inside of the opening 31 of the follower plate 3 are filled with the urethane adhesive U is maintained. In other words, it is possible to suppress a situation where the urethane adhesive U flows out from the lower space 51*c* of the drum pump 5 and the inside of the opening 31 of the follower plate 3, and air enters the lower space 51*c* and the inside of the opening 31 of the follower plate 3 when the follower plate 3 is taken out from the tank 2.

Figure 8:
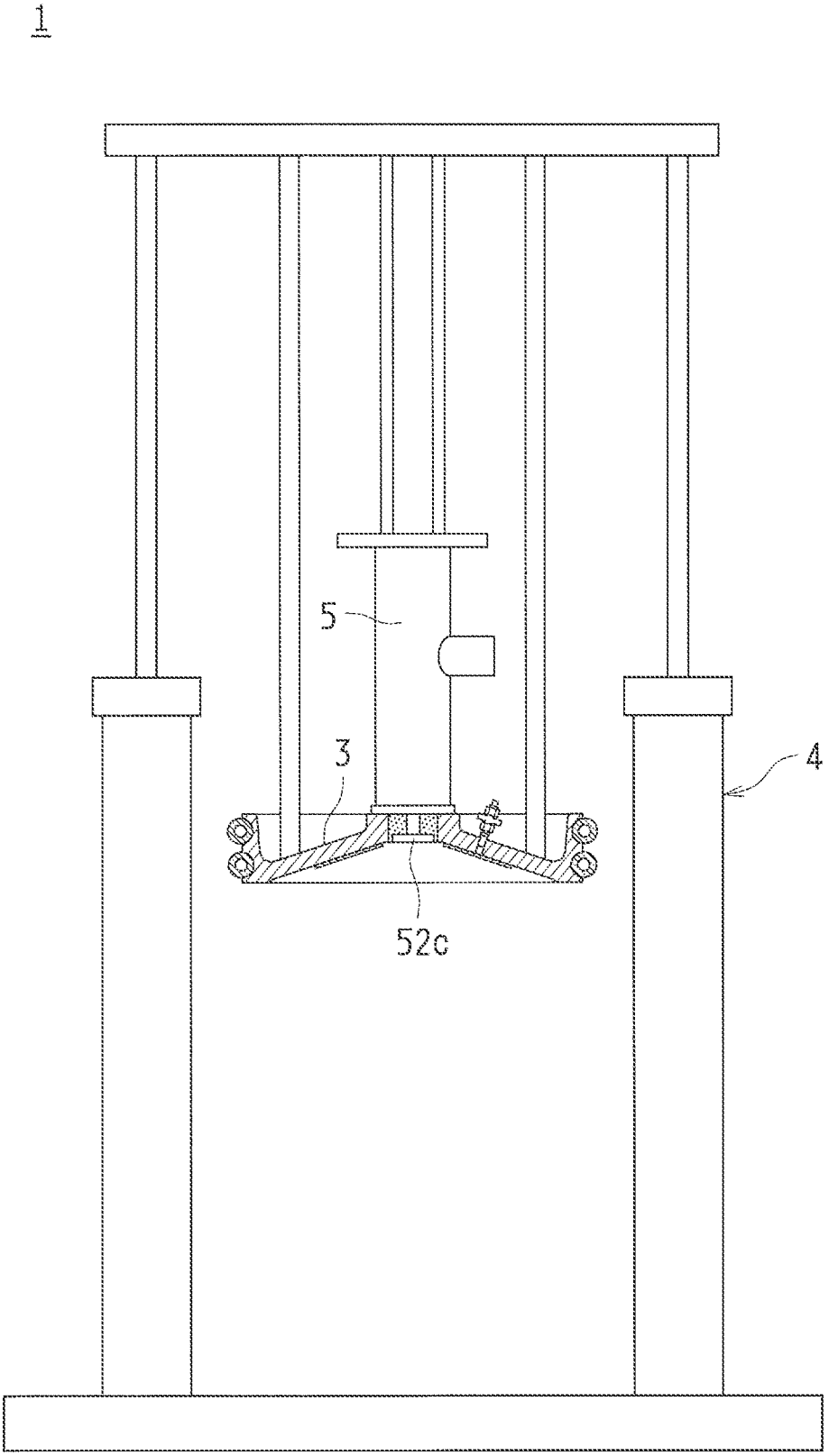
FIG. 8 is a view corresponding to FIG. 1 showing a state after the tank is carried out in the replacement operation of the tank.

In such a state, the follower plate 3 is positioned above the upper end of the tank 2 by a predetermined dimension and retracted from the upper end of the tank 2 to remove the urethane adhesive U adhering to the follower plate 3 and carry out the empty tank 2. FIG. 8 is a view corresponding to FIG. 1 showing a state after the tank 2 is carried out.

Figure 9:
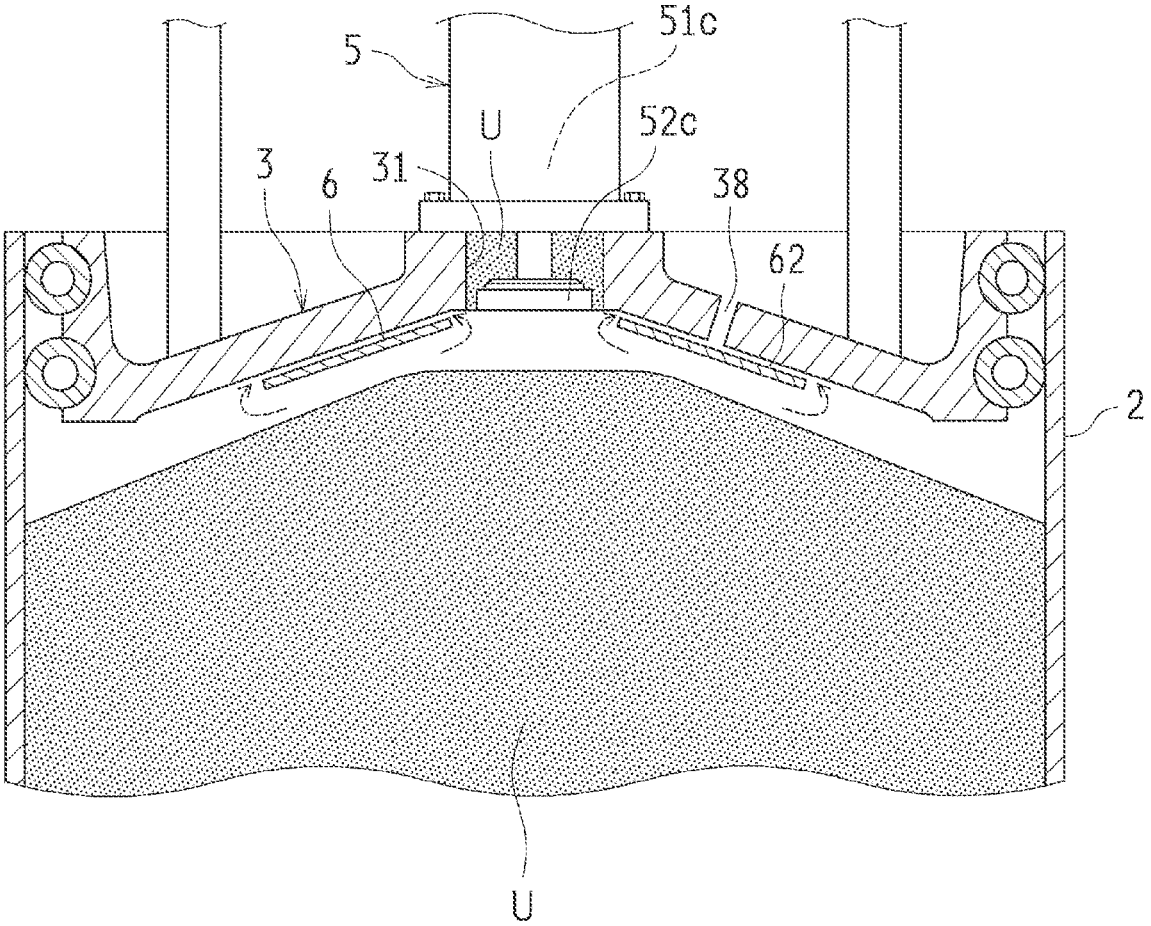
FIG. 9 is a sectional view of the follower plate and its periphery illustrating an air bleeding operation.

Subsequently, a new tank (tank in which the urethane adhesive U is stored) 2 is carried in. That is, the new tank 2 is disposed on the base plate 11. Then, the cylinders 41, 41 are operated to lower the follower plate 3, and the follower plate 3 is inserted into the tank 2. As shown in FIG. 9, at the time when the follower plate 3 is inserted into the tank 2, air is present between the follower plate 3 and the urethane adhesive U. Thus, an operation of discharging the air (air bleeding operation) is performed. In the air bleeding operation, the air bleeding plug 35 (not shown in FIG. 9) is opened to operate the vacuum pump, and the follower plate 3 is lowered to discharge the air from the air bleeding hole 38.

Specifically, in the air bleeding operation, the upper surface of the urethane adhesive U comes into contact with the lower surface of the auxiliary plate 6 as the follower plate 3 is lowered while discharging the air from the air bleeding hole 38. In this state, since the communication path 62 is secured between the lower surface of the follower plate 3 and the upper surface of the auxiliary plate 6, the air in the tank 2 passes through the communication path 62 and is discharged through the air bleeding hole 38 (see dashed arrows in FIG. 9). That is, with the state where the air in the tank 2 and the air bleeding hole 38 communicated with each other by the communication path 62 maintained, the air is effectively discharged. After the air in the tank 2 is discharged to the outside, the vacuum pump is stopped and the air bleeding plug 35 is closed, whereby the air bleeding operation is completed. As an example of means for detecting that the air in the tank 2 has been discharged to the outside, when the degree of vacuum measured by a vacuum gauge provided in the vacuum pump exceeds a preset threshold value, it is determined that the air in the tank 2 has been discharged to the outside.

After the air in the tank 2 is discharged to the outside in this way, the urethane adhesive U in the tank 2 and the urethane adhesive U that has filled the lower space 51*c* of the drum pump 5 and the entire inside of the opening 31 of the follower plate 3 are combined, and the fluid pressure feeding device 1 can be restarted in a state where no air remains in the tank 2, the lower space 51*c* of the drum pump 5, and the entire inside of the opening 31 of the follower plate 3.

Effects of Embodiment

As described above, the present embodiment includes the position control unit 101 capable of controlling the position of the primer plate 52*c* that reciprocates between the inside of the tank 2 and the lower space 51*c* of the drum pump 5 to pump up the urethane adhesive U in the tank 2 to the lower space 51*c*, so that when the follower plate 3 is taken out from the tank 2, the position control unit 101 positions the primer plate 52*c* in the opening 31 of the follower plate 3. Therefore, it is possible to suppress the situation where the urethane adhesive U flows out from the lower space 51*c* of the drum pump 5 and the inside of the opening 31 of the follower plate 3, and air enters the lower space 51*c* of the drum pump 5 and the inside of the opening 31 of the follower plate 3 when the follower plate 3 is taken out from the tank 2, which eliminates the need to perform so-called blank pumping of the pump before restarting the fluid pressure feeding device 1 after the replacement operation of the tank 2, and thus reduces the amount of waste of the urethane adhesive U.

In particular, as means for restraining the urethane adhesive U from flowing out from the lower space 51*c* of the drum pump 5 and the inside of the opening 31 of the follower plate 3, it is conceivable to provide a check valve in the opening 31 of the follower plate 3. However, in the present embodiment, the primer plate 52*c* of the drum pump 5 is effectively used to restrain the urethane adhesive U from flowing out, so that no special means such as a check valve is required, and the configuration of the fluid pressure feeding device 1 is kept from becoming complicated.

Modification of Primer Plate

Figure 10:
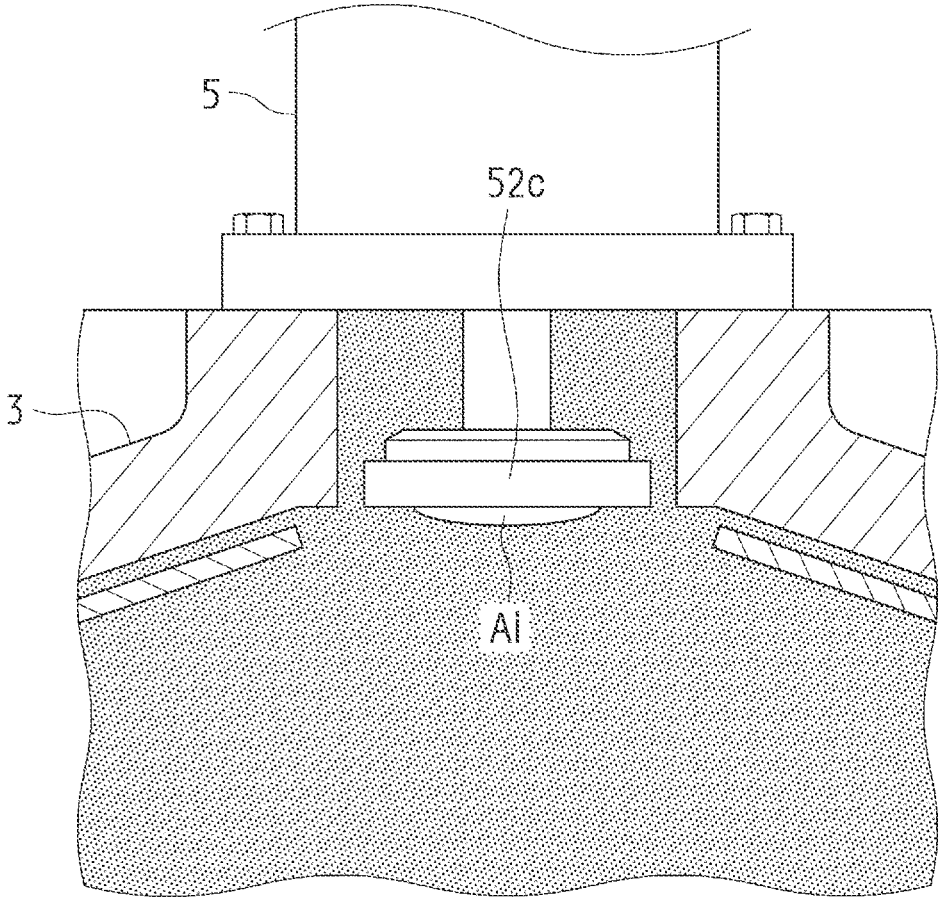
FIG. 10 is a view showing a state in which air remains in the vicinity of the lower surface of a primer plate when the lower surface is a flat surface.

Next, a modification of the primer plate 52*c* will be described. The lower surface of the primer plate 52*c* in the above-described embodiment is a flat surface. In this case, the air may remain near the lower surface of the primer plate 52*c* in the air bleeding operation (air bleeding operation during the replacement operation of the tank). FIG. 10 shows a state where air Ai remains in the vicinity of the lower surface of the primer plate 52*c* at the end of the air bleeding operation when the entire lower surface of the primer plate 52*c* is a flat surface.

Figure 11:
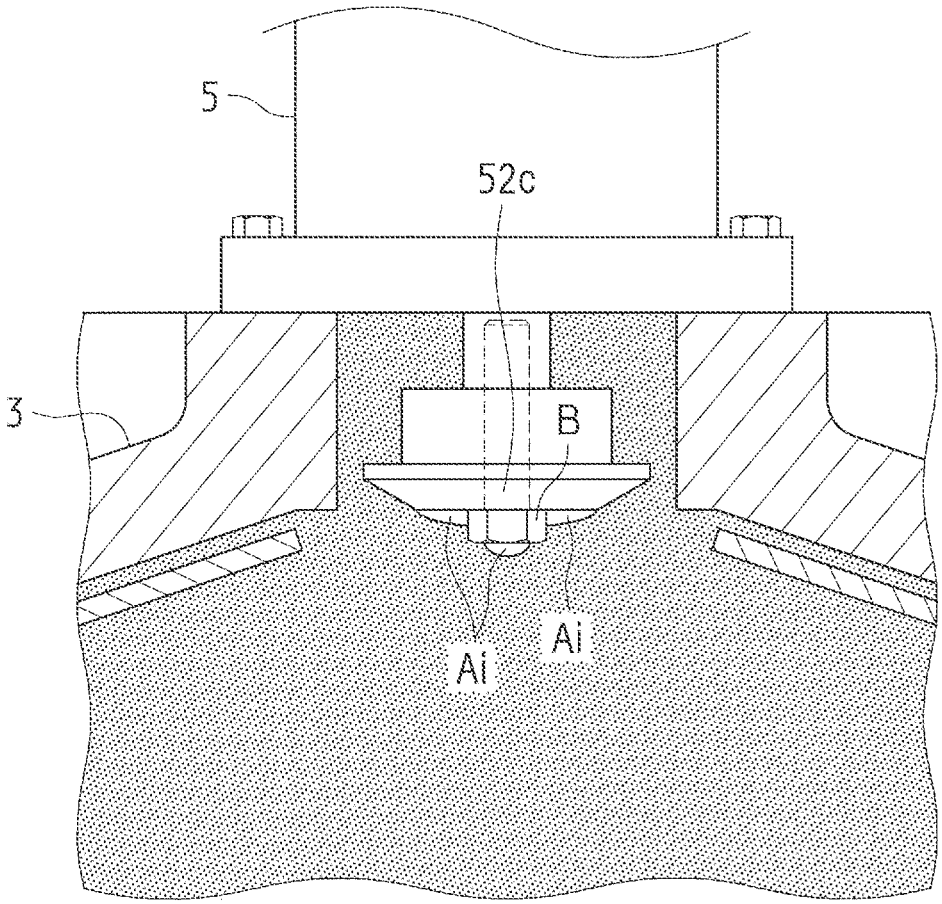
FIG. 11 is a view showing a state in which air remains in the vicinity of the lower surface of a head of a bolt when the primer plate is bolted to the lower portion of a pump rod.

Further, as shown in FIG. 11, even in the case where the primer plate 52*c* is bolted to the lower portion of the pump rod 52 (the primer plate 52*c* is bolted from below), air Ai may remain in the vicinity of the lower surface (flat surface) of the head of the bolt B or in the vicinity of the lower surface of the primer plate 52*c*.

When such air Ai remains, there is a possibility that the air Ai flow into the drum pump 5.

In this modification, the shape of the lower surface of the primer plate 52*c* is improved in order to suppress air from remaining in the vicinity of the lower surface of the primer plate 52*c* in the air bleeding operation.

Figure 12:
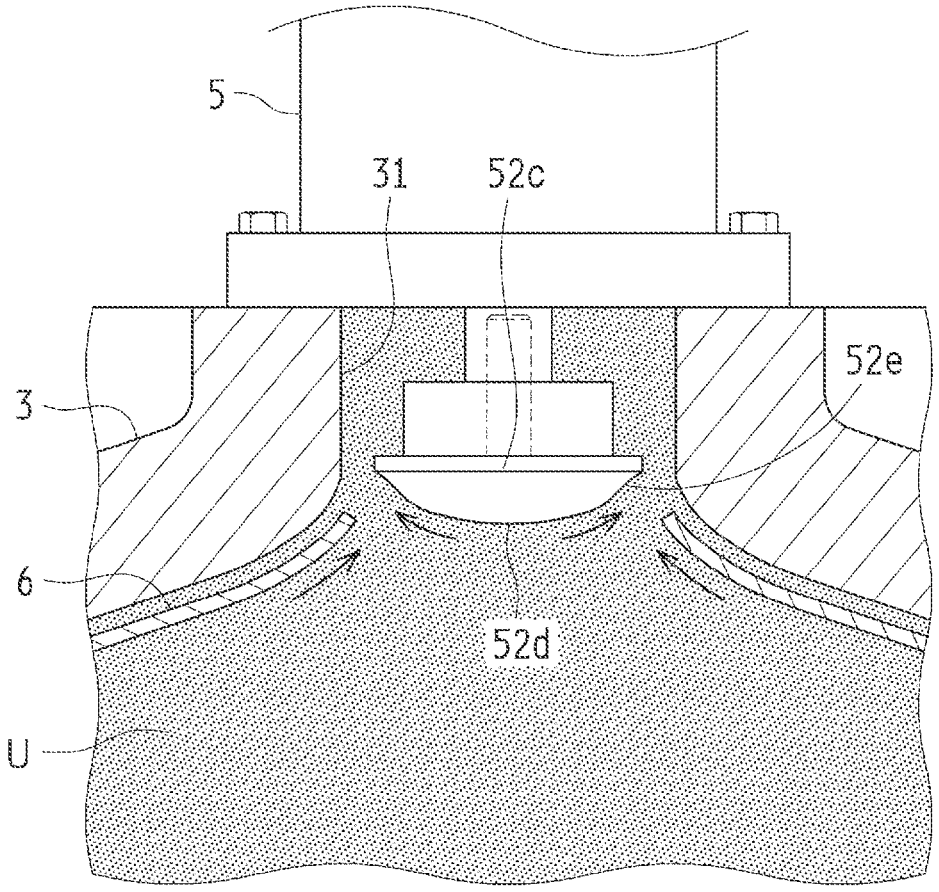
FIG. 12 is a sectional view showing the periphery of a primer plate according to a modification.
Figure 13:
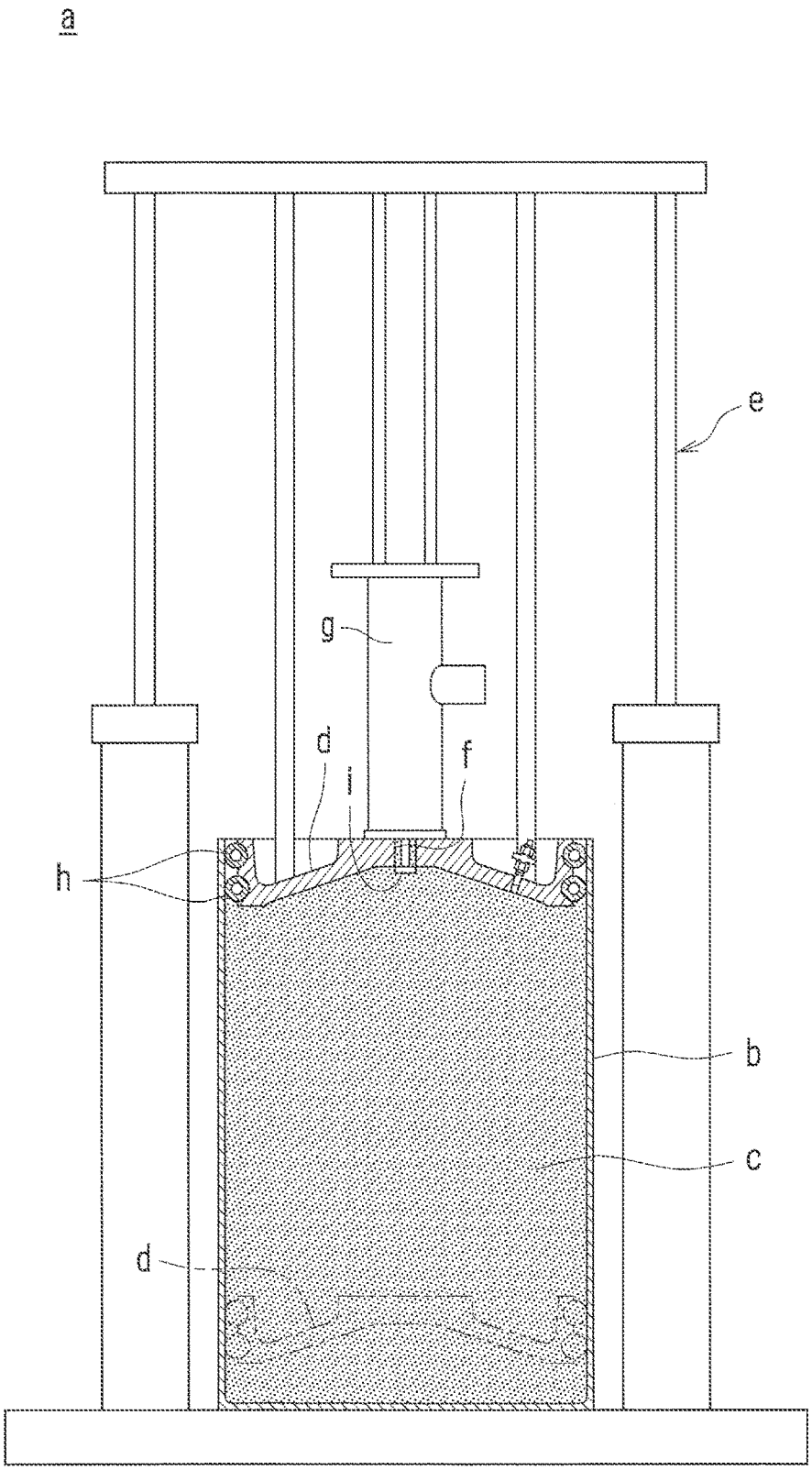
FIG. 13 RELATED ART
FIG. 13 is a sectional view showing a part of a fluid pressure feeding device in a related art.
Figure 14:
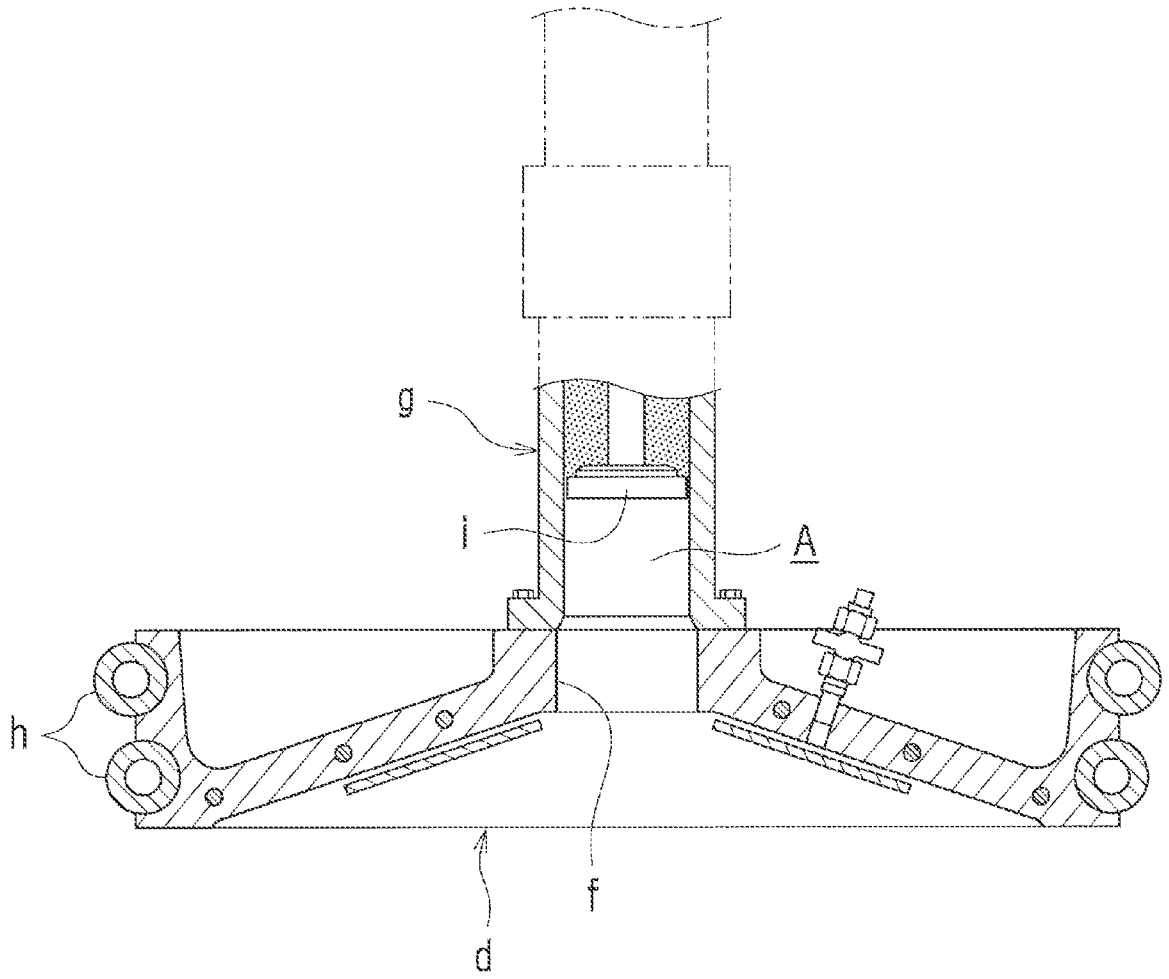
FIG. 14 RELATED ART
FIG. 14 is a sectional view showing a follower plate and a part of a drum pump that are taken out from the inside of a tank in a replacement operation of the tank in the related art.
Figure 15A:
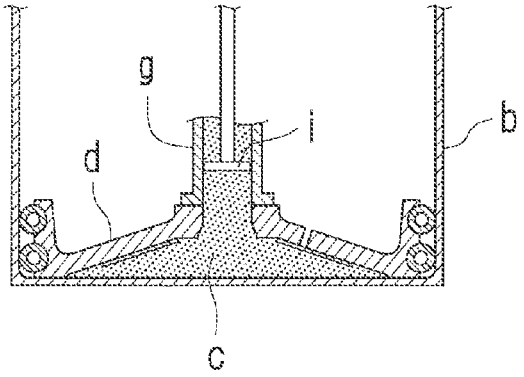
FIG. 15A RELATED ART
FIG. 15A is a diagram illustrating a situation in which air enters a pump internal space or the like in the related art.
Figure 15B:
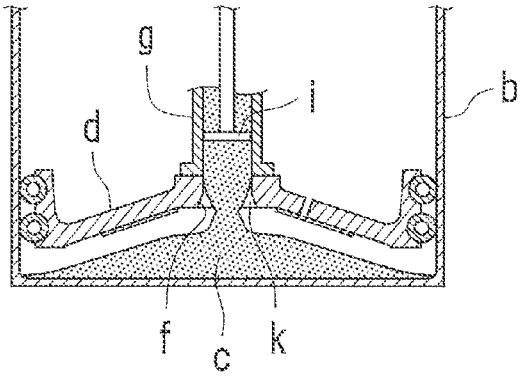
FIG. 15B RELATED ART
FIG. 15B is a diagram illustrating a situation in which air enters a pump internal space or the like in the related art.
Figure 15C:
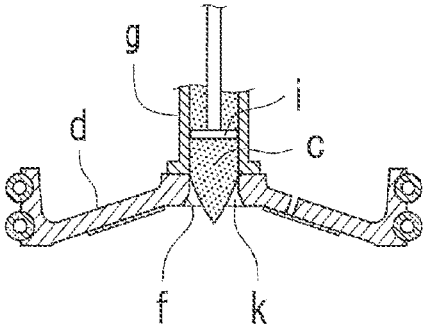
FIG. 15C RELATED ART
FIG. 15C is a diagram illustrating a situation in which air enters a pump internal space or the like in the related art.
Figure 15D:
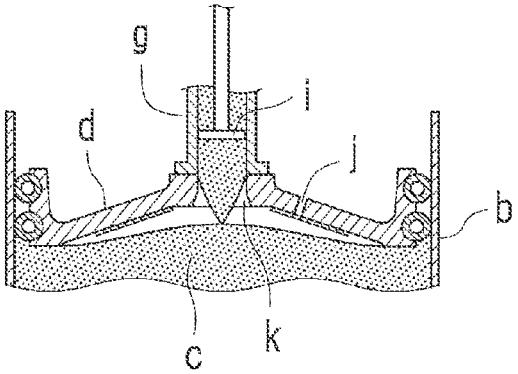
FIG. 15D RELATED ART
FIG. 15D is a diagram illustrating a situation in which air enters a pump internal space or the like in the related art.
Figure 15E:
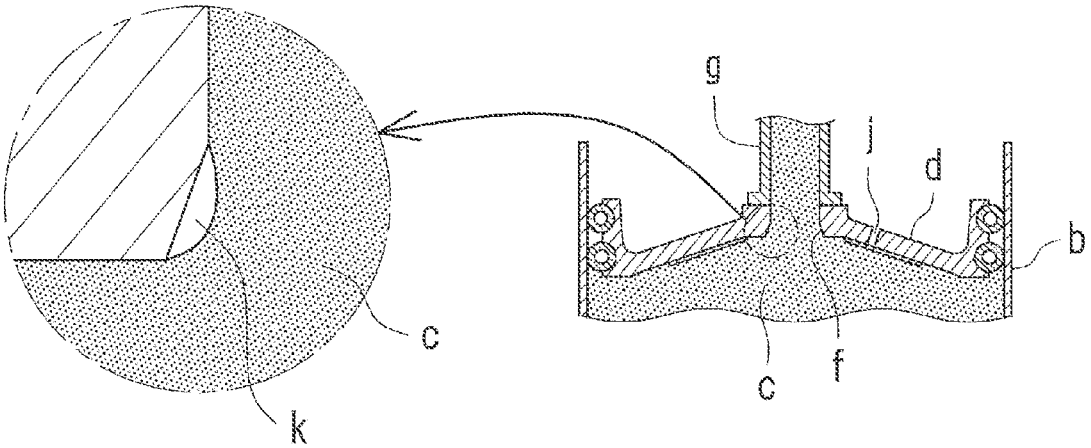
FIG. 15E RELATED ART
FIG. 15E is a diagram illustrating a situation in which air enters a pump internal space or the like in the related art.

FIG. 12 is a sectional view showing the periphery of the primer plate 52*c* according to the present modification. As shown in FIG. 12, the primer plate 52*c* according to the present modification has a lower surface having a curved shape that bulges downward toward the center of the lower surface.

More specifically, the central portion of the lower surface is a substantially spherical central curved surface portion 52*d* that protrudes downward, whereas the portion on the outer peripheral side of the central curved surface portion 52*d* is an outer curved surface portion 52*e* which is smoothly continuous with the central curved surface portion 52*d* and has a slightly recessed curve. The curvature of the central curved surface portion 52*d* (the curvature that protrudes downward) is larger than the curvature of the outer curved surface portion 52*e* (the curvature that is recessed). As described above, the lower surface of the primer plate 52*c* in the present modification has a downwardly protruded shape.

The shape of the lower surface of such a primer plate 52*c* corresponds to a configuration in which "the end surface of the primer plate facing the tank in the state where the primer plate is positioned in the opening of the follower plate has a curved surface shape that protrudes toward the tank toward the center of the end surface" in the disclosure.

With such a configuration, in the operation of inserting the follower plate 3 into the new tank 2 after replacement, the urethane adhesive U in the tank 2 flows along the lower surface of the follower plate 3 (more specifically, the lower surface of the auxiliary plate 6) and the lower surface of the primer plate 52*c* as shown by the arrows in FIG. 12. That is, the urethane adhesive U in the tank 2 flows so as to gather in the region between the lower surface of the follower plate 3 and the lower surface of the primer plate 52*c*. Thereby, the air in the tank 2 can be sent out to the air bleeding hole 38 (not shown in FIG. 12) via the communication path 62 with no air remaining between the lower surface of the auxiliary plate 6 and the urethane adhesive U, or between the lower surface of the primer plate 52*c* (the central curved surface portion 52*d* and the outer curved surface portion 52*e*) and the urethane adhesive U. In particular, since the primer plate 52*c* is located in the opening 31 of the follower plate 3, the lower surface of the follower plate 3 pushes away the urethane adhesive U and the lower surface of the primer plate 52*c* (the lower surface of the auxiliary plate 6) pushes away the urethane adhesive U at the same time along with the insertion operation of the follower plate 3. Therefore, the air in the tank 2 can be discharged to the outside of the tank 2 from the air bleeding hole 38 without remaining in the vicinity of the end surface of the primer plate 52*c*.

In particular, when inserting the follower plate 3 into the tank 2, even when the upper surface of the urethane adhesive U is not horizontal (for example, even when a part of the upper surface of the urethane adhesive U protrudes upward or even when the upper surface of the urethane adhesive U is inclined toward one side), the urethane adhesive U can flow so that air does not remain in the vicinity of the end surface of the primer plate 52*c*, whereby the air can be effectively discharged from the air bleeding hole 38 to the outside of the tank 2.

Other Embodiments

The disclosure is not limited to the above-described embodiment nor to the above-described modification, and all modifications and applications included in the scope of the claims and a range equivalent to the scope of the disclosure can be made.

For example, the embodiment and the modification describe the case where the disclosure is applied to the fluid pressure feeding device 1 that pressure-feeds the urethane adhesive U to be applied to the window glass toward the coating robot in the vehicle manufacturing line. The disclosure is not limited to this, and can also be applied to a fluid pressure feeding device that pressure-feeds a fluid other than the urethane adhesive U toward the fluid path.

Further, in the above-described embodiment, when the follower plate 3 is taken out from the tank 2, the position of the primer plate 52*c* is adjusted so that the lower surface of the primer plate 52*c* and the lower surface of the central portion 32 of the follower plate 3 are flush with each other. The disclosure is not limited to this, and the lower surface of the primer plate 52*c* may be positioned slightly below or above the lower surface of the central portion 32 of the follower plate 3, as long as the position of the primer plate 52*c* is adjusted to a position where the urethane adhesive U does not flow out from the lower space 51*c* of the drum pump 5 and the inside of the opening 31 of the follower plate 3.

Further, in the embodiment and the modification, the follower plate 3 is configured to apply the pressing force to the urethane adhesive U in the tank 2 from above. The disclosure is not limited to this, and the follower plate may apply a pressing force to the urethane adhesive in the tank in the lateral direction (horizontal direction).

Further, in the embodiment and the modification, the so-called blank pumping of the pump is not performed before restarting the fluid pressure feeding device after the replacement operation of the tank 2. However, the disclosure does not completely eliminate the blank pumping of the pump and the blank pumping may be performed as necessary. Even in this case, since air does not enter the lower space 51*c* of the drum pump 5 and the inside of the opening 31 of the follower plate 3, the number of times of the blank pumping can be reduced, and the amount of waste of the urethane adhesive U can be reduced.

Further, in the embodiment and the modification, a replacement operation of the tank is described. However, the embodiment and the modification can also be applied to operations such as an inspection operation and so on.

The disclosure can be applied to a fluid pressure feeding device that pressure-feeds a urethane adhesive to be applied to a window glass toward a coating robot in a vehicle manufacturing line.

What is claimed is:

1. A fluid pressure feeding device comprising:

a follower plate that is inserted into a tank storing a fluid, that applies a pressing force to the fluid, and that has an opening for pumping up the fluid from an inside of the tank;

a pump having a pump internal space communicating with the opening of the follower plate and having a primer plate configured to exhibit reciprocating movement between the inside of the tank and the pump internal space to pump up the fluid in the tank into the pump internal space; and a position control unit configured to control a position of the primer plate within a range of the reciprocating movement, wherein an outer shape of the primer plate substantially matches a shape of the opening of the follower plate, and the position control unit is configured such that the primer plate is positioned in the opening of the follower plate when the follower plate is taken out from the tank.

2. The fluid pressure feeding device according to claim 1, further comprising:

an air motor serving as a power source for causing the reciprocating movement of the primer plate; and a switching valve configured to switch between supply and non-supply of air to the air motor, wherein the position control unit is configured to switch the switching valve, such that in taking out the follower plate from the tank, to supply air to the air motor to move the primer plate toward the opening of the follower plate, and when the primer plate reaches the opening of the follower plate, to block air supply to the air motor.

3. The fluid pressure feeding device according to claim 2, wherein the follower plate is provided with an air bleeding hole that is for air in the tank being discharged an end surface of the primer plate facing the tank in a state where the primer plate is positioned in the opening of the follower plate has a curved surface shape that protrudes toward the tank toward a center of the end surface.

4. The fluid pressure feeding device according to claim 2, wherein when the primer plate reaches the opening of the follower plate, a gap between an outer peripheral surface of the primer plate and an inner peripheral surface of the opening of the follower plate is a gap such that the fluid inside the opening of the follower plate does not flow down.

5. The fluid pressure feeding device according to claim 2, wherein the position control unit is configured to switch the switching valve such that during a replacement operation of the tank, in taking out the follower plate from the tank, to supply air to the air motor to move the primer plate toward the opening of the follower plate, and when the primer plate reaches the opening of the follower plate, to block air supply to the air motor.

6. The fluid pressure feeding device according to claim 1, wherein the follower plate is provided with an air bleeding hole that is for air in the tank being discharged, and an end surface of the primer plate facing the tank in a state where the primer plate is positioned in the opening of the follower plate has a curved surface shape that protrudes toward the tank toward a center of the end surface.

7. The fluid pressure feeding device according to claim 1, wherein the position control unit is configured such that during a replacement operation of the tank, the primer plate is positioned in the opening of the follower plate when the follower plate is taken out from the tank.

* * * * *